US008037832B2

(12) United States Patent
Pellegrini

(10) Patent No.: US 8,037,832 B2
(45) Date of Patent: Oct. 18, 2011

(54) MEETING TABLE

(75) Inventor: Mauro Pellegrini, Senigallia (IT)

(73) Assignee: Videoworks S.p.A. (IT)

( * ) Notice: Subject to any disclaimer, the term of this patent is extended or adjusted under 35 U.S.C. 154(b) by 166 days.

(21) Appl. No.: 12/385,328

(22) Filed: Apr. 6, 2009

(65) Prior Publication Data

US 2010/0116175 A1 May 13, 2010

(30) Foreign Application Priority Data

Nov. 11, 2008 (IT) ..... BO2008A0682

(51) Int. Cl.
*A47B 37/00* (2006.01)

(52) U.S. Cl. ..... 108/50.01; 312/223.3

(58) Field of Classification Search ..... 312/223.3; 108/50.01–50.02

See application file for complete search history.

(56) References Cited

U.S. PATENT DOCUMENTS

| | | | | |
|---|---|---|---|---|
| 6,556,678 | B1 | 4/2003 | Boyce | |
| 7,047,890 | B2 * | 5/2006 | Korber et al. | 108/50.01 |
| 2006/0191445 | A1 * | 8/2006 | Stengel et al. | 108/50.01 |

FOREIGN PATENT DOCUMENTS

| | | |
|---|---|---|
| DE | 9405538 | 6/1994 |
| DE | 29910808 | 12/1999 |
| EP | 0995369 | 4/2000 |
| GB | 2415129 | 12/2005 |

OTHER PUBLICATIONS

Italian Search Report dated Oct. 15, 2009 from counterpart patent application.

European Search Report dated Feb. 5, 2010 from counterpart patent application.

European Patent Office Office Action dated Feb. 3, 2011 from counterpart patent application.

* cited by examiner

*Primary Examiner* — Hanh V Tran

(74) *Attorney, Agent, or Firm* — Timothy J. Klima; Shuttleworth & Ingersoll, PLC

(57) ABSTRACT

A meeting table (1), below its horizontal top (7) which forms a working area, has a container (10) housing a system (2) for remote conferences, in particular for telepresence or videoconference meetings; inside the perimeter of the top (7), at least one video screen (12) of the system (2) for remote conferences can move between a first, raised position, in which it rises up from the working area, and a second, lowered position, in which it is housed in a retracted fashion below the working area, in particular inside the container (10).

9 Claims, 8 Drawing Sheets

MEETING TABLE

BACKGROUND OF THE INVENTION

The invention relates to a meeting table.

A meeting table is usually designed in such a way that a plurality of people can comfortably interact with each other from respective positions distributed around the table.

However, increasingly often, in meeting rooms, videoconference systems are connected to the above-mentioned tables.

In such cases, a camera is angled towards the table so that it can frame the people gathered there, and a screen is turned towards the table so that participants can see the images of another meeting room connected in videoconference. Alongside the video reception and transmission system there is a system for the reception and transmission of sound and data.

Videoconference techniques have increasingly spread in recent years, but they have not succeeded in completely eliminating the need for meeting in person. This is mainly due to the difficulty in picking up various subtle aspects of the gestures, voices and facial expressions of the participants present in a remote meeting room.

To at least partly solve said problem, and in particular to improve both the camera framing angles and the screen viewing angles, the videoconference system is usually installed so that it abuts the table, thus sacrificing a certain number of working positions around the table. Obviously, according to said solution, the table can always be moved or the videoconference system removed. However, in practice, such a possibility is almost always renounced, and in fact, already at the meeting room design stage, often it is expected that a meeting table will be sized and/or shaped specifically so that it can permanently abut a videoconference system.

At the same time, the capacity for simulating physical interaction between remote meeting rooms has significantly increased thanks to new telepresence technologies.

Unlike in videoconference systems, in the more recent telepresence systems for each sector of the meeting table there is a respective high definition directional audio-video system. More specifically, a camera and a high definition screen, a microphone and a system of loudspeakers, preferably multi-channel. Data transfer takes place using standard IP technology and requires an integrated audio/video/data network.

In that way, each participant can see another participant in real time, by means of high definition images (1920×1080 native) and life-size (1:1). At the same time, the audio system positions the voice in such a way as to give the impression that it is coming from the person on the screen.

Obviously, compared with a simpler videoconference system, the greater number cameras, screens, microphones and loudspeakers, as well as more complex wiring, resulted in the design of meeting rooms and meeting tables specifically designed for telepresence purposes.

In particular there are prior art solutions involving a meeting table, on one side of which, opposite the positions of the real participants, one or more high definition screens rise up. The latter show symmetrically an identical, virtual meeting table, which is physically located in a remote position but which appears to be facing the real table. In that way, the positions of the real participants are facing, in a realistic fashion, the positions of the virtual participants, as if the latter were actually present in the room. For example, a virtual table for twelve participants may be produced using two real tables, each at a location remote from the other, having six seats on one side and three high definition screens on the opposite side.

Obviously, a meeting table designed for the use indicated above is, also in this case, difficult to use in a more traditional context. The significant size of the high definition screens positioned on one side of the table only allows actual use of the opposite half of the table. For the same reason, the entire meeting room designed for telepresence is difficult to use as a traditional meeting room, leading to an obvious waste of space and resources.

SUMMARY OF THE INVENTION

The aim of the invention is to provide a versatile meeting table, which can be used in an optimum way both for traditional meetings and for videoconference or telepresence meetings.

The invention also has for an aim to provide a meeting table which reduces the times and/or costs of installation and configuration of a meeting room designed both for traditional meetings and for videoconference or telepresence meetings.

Accordingly, the invention provides a meeting table comprising the features described in claim 1 or in any of the claims directly or indirectly dependent on claim 1.

BRIEF DESCRIPTION OF THE DRAWINGS

The invention will now be described, by way of example only and without limiting the scope of the inventive concept, with reference to the accompanying drawings, in which.

DESCRIPTION OF THE PREFERRED EMBODIMENTS

Figure 1:
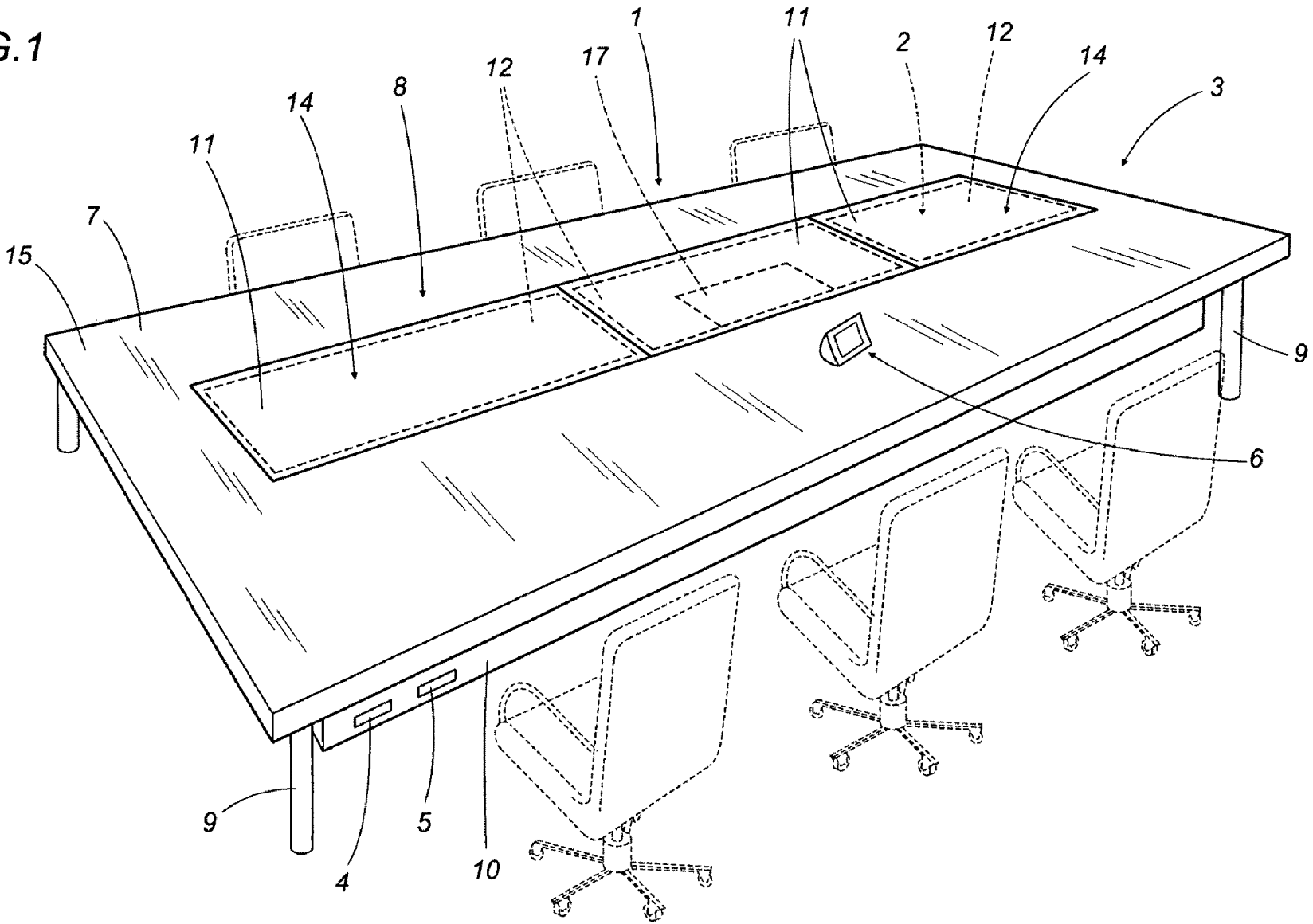
FIG. 1 is a perspective view of a meeting table made according to the invention and in a closed configuration.
Figure 2:
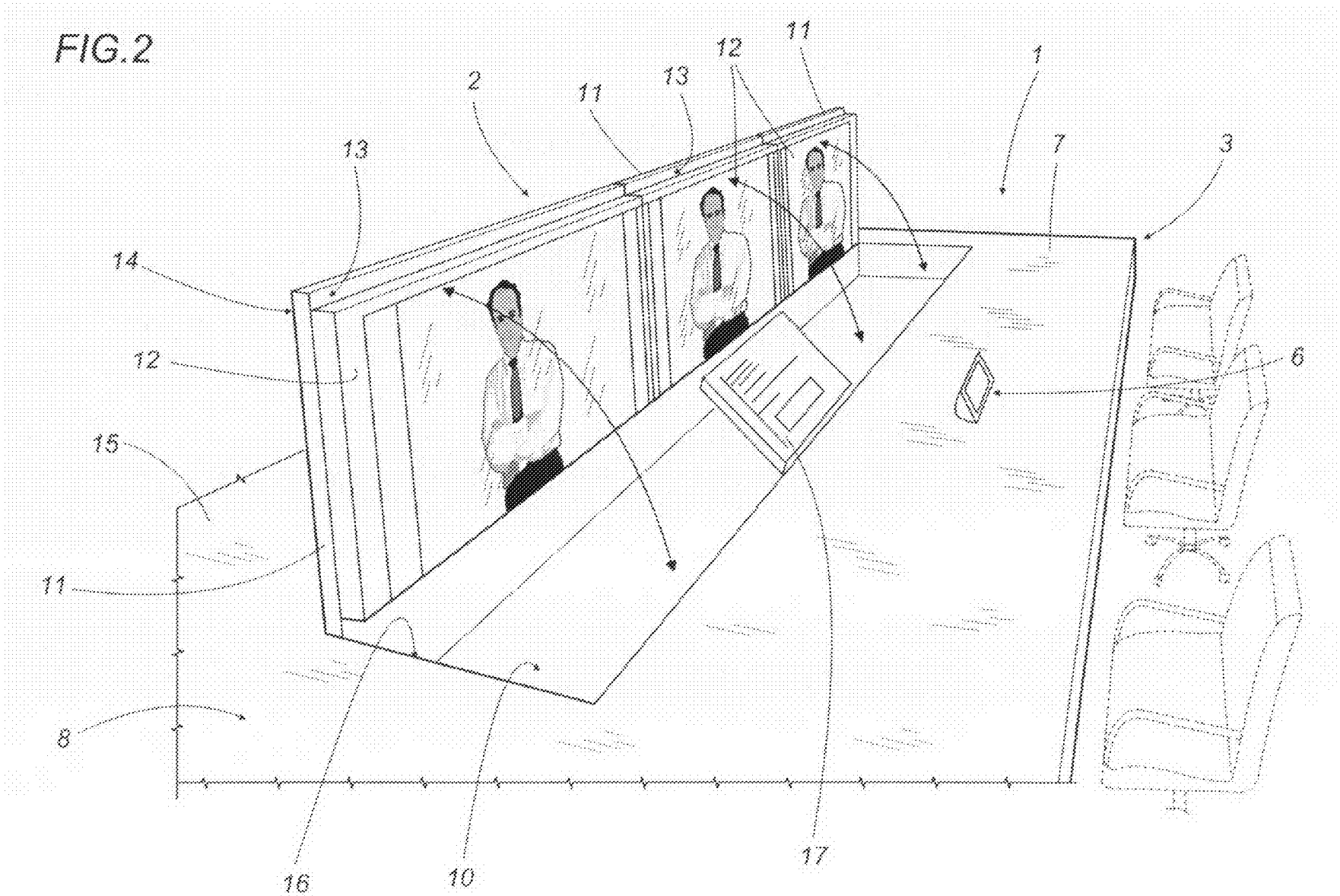
FIGS. 2, 3 and 4 are respective perspective views of the table of FIG. 1 in an open configuration allowing a telepresence meeting.
Figure 3:
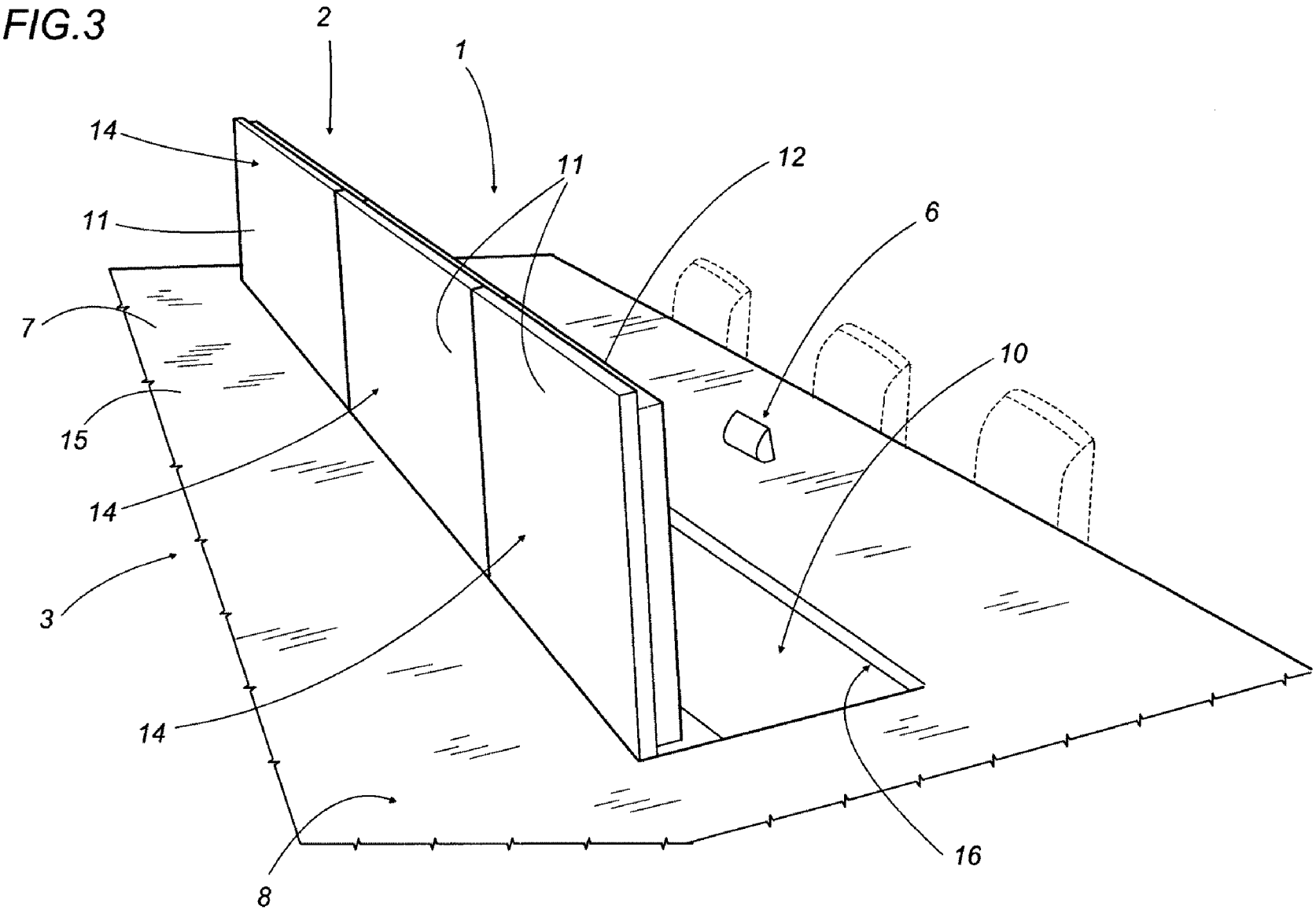
Figure 4:
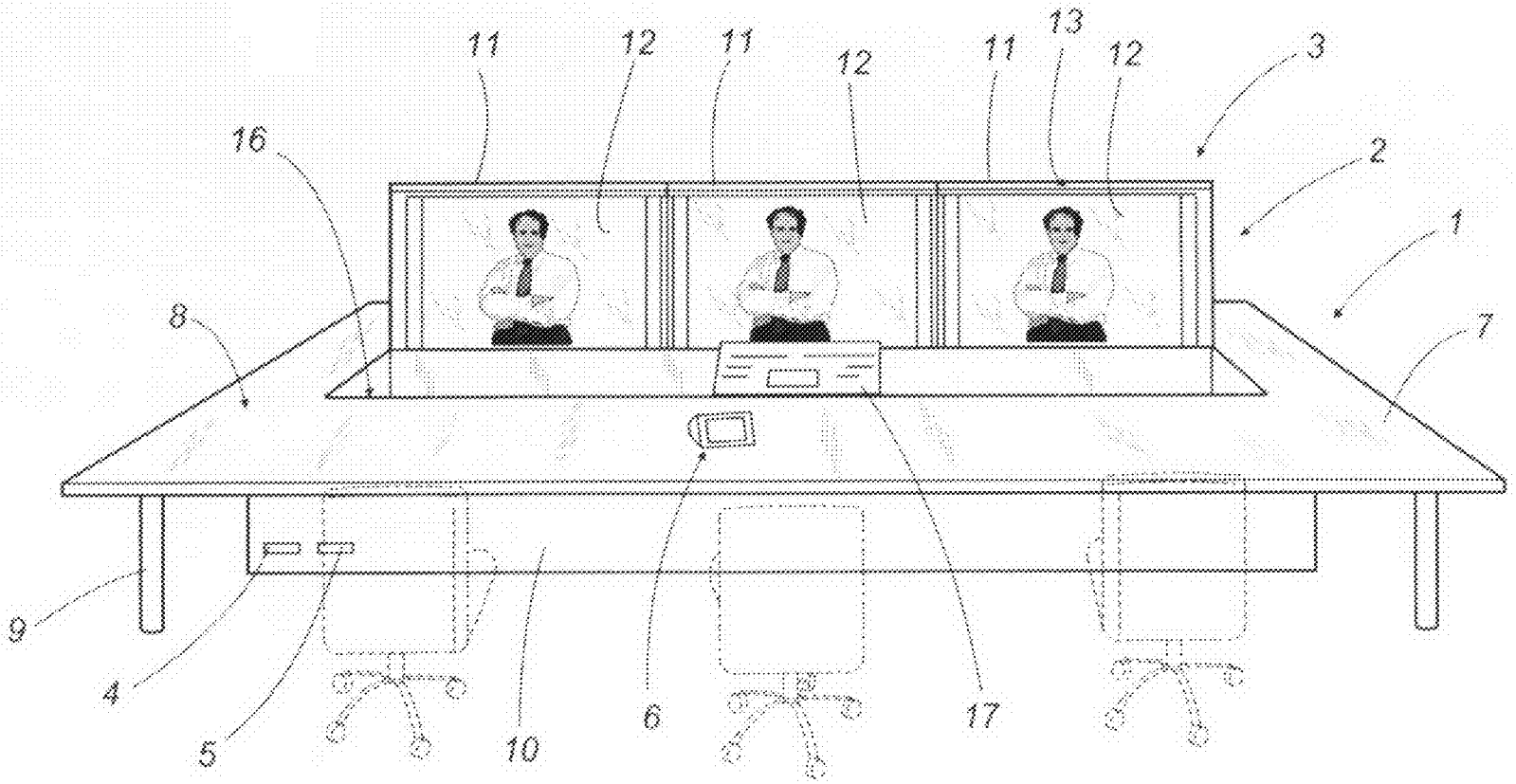

In FIGS. 1 to 7, the numeral 1 denotes a meeting table with an integrated, retractable remote conference system 2, in particular a telepresence system.

The table 1 and the system 2 form an equipped, transportable and ready-to-use structure 3, in which both the hardware and the software of the system 2 are already set up so that the user can rapidly make use of them. For this purpose the structure 3 interfaces with the outside environment by means of at least one electrical input section 4, at least one input/output section 5 for data reception and transmission using standard IP technology, and a module 6 for interfacing with the user, preferably of the portable, wireless and touch screen type.

The table 1 comprises a horizontal top 7, its upper surface 8 forming a working area, and a plurality of legs 9 supporting the top 7.

Figure 7:
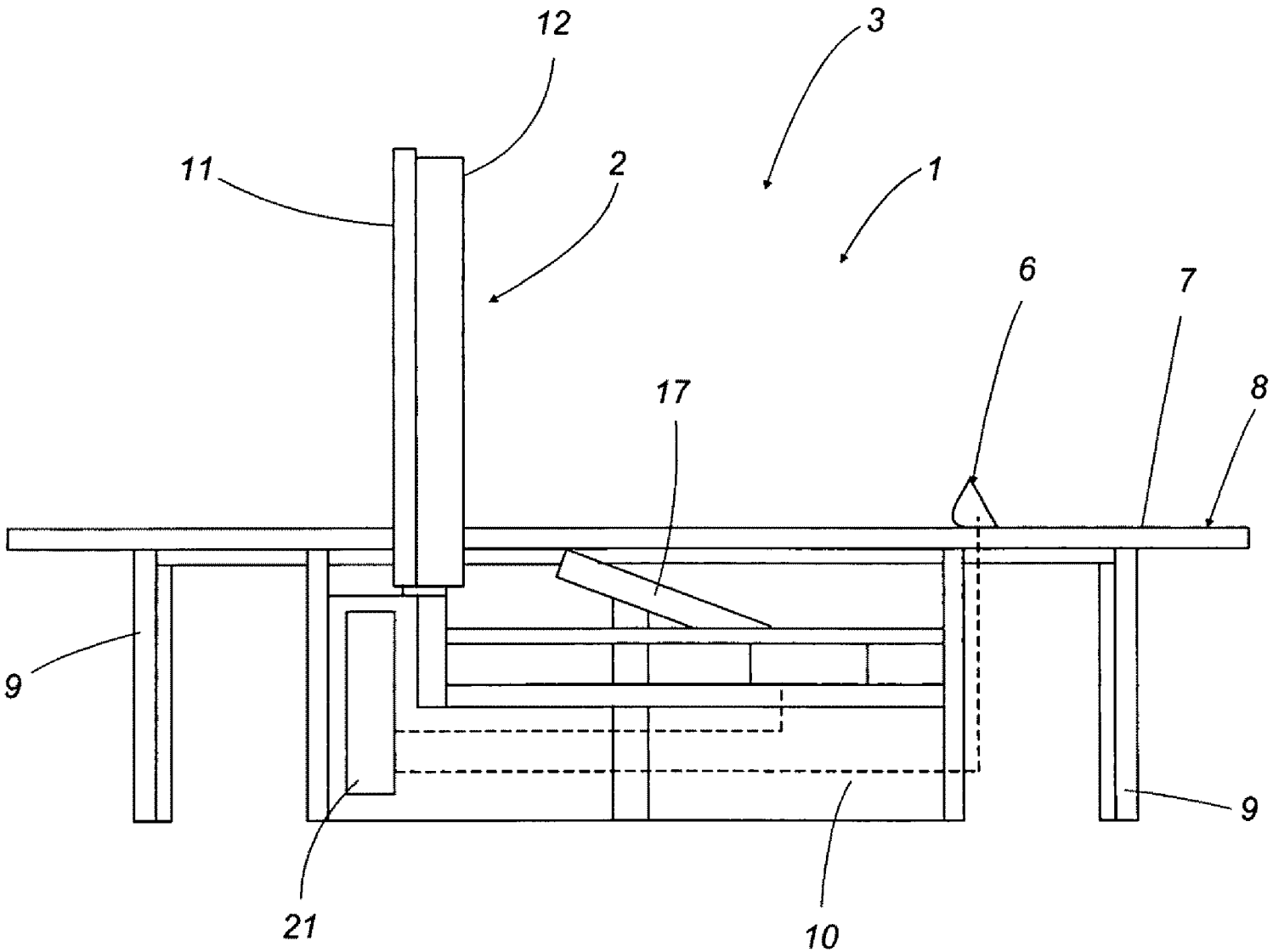
FIG. 7 is a cross-section of the table of FIG. 1 in an open configuration.

Below the top 7, the table 1 comprises a box-shaped body 10, extending from the top 7, to which it is fixed, down to the floor. As FIG. 7 shows more clearly, the body 10 only occupies a central region below the top 7, leaving enough room for the legs of the users at the meeting.

The body 10 is a container housing the system 2, and the sections 4 and 5 are mounted on one of its lateral walls.

The body 10 may have a load-bearing function, in which case it acts not just as a container but also as a supporting base. In such a case, according to an alternative embodiment not illustrated, the legs 9 may be absent.

Inside the working are, in a central region of the area, the top 7 has three rectangular hinged lift-up panels 11, each supporting in a retractable fashion a video screen 12, in particular a high definition (1920×1080 native) plasma, LCD or similar monitor.

The lift-up panels 11 are side by side and adjacent to each other, with the respective hinges aligned, one next to the other, along a shared axis of rotation, and they represent a mobile central part of the top 7, at the centre of the working area and surrounded all around by a fixed part 15.

The lift-up panels 11 can rotate independently between a first, lifted up position (FIGS. 2 to 7), in which each, by means of its front face 13, supports the respective screen 12 in an upright position, and a second, lowered position (FIGS. 1 and 5), in which each, with its rear face 14, lies coplanar with the fixed part 15 of the top 7, said rear face 14 guaranteeing the working area substantial surface continuity. In other words, with the three lift-up panels 11 closed, the surface 8 of the table 1 can be completely and comfortably used by the users present at the meeting, all around the table, using the table in a traditional way.

With the lift-up panels 11 in their lowered position, said panels are housed, flush with the surface 8, inside a rectangular opening 16 in the top 7. The opening 16 gives onto the inside of the container 10.

As shown in FIGS. 2, 3, 4 and 6, the lift-up panels 11, as well as being coplanar with each other in the lowered position, are also coplanar with each other in the lifted up position, in which they support the respective video screens 12 in such a way that they are side by side and aligned along a plane of vision rising from the top 7.

Each video screen 12, being integral with the respective lift-up panel 11, can therefore move between a first, raised position, in which it rises up from the working area, and a second, lowered position, in which it is housed in a retracted fashion below the working area. More precisely, in its lowered position, the video screen 12 lies parallel with the working area and faces the inside of the container 10.

In addition to the video screens 12, at the central video screen 12 and again inside the working area, the table 1 comprises at least one screen 17 for displaying data, also being part of the system 2.

The screen 17 can move between a first, raised position (FIGS. 2 and 4), in which it rises up from the working area, and a second, lowered position (FIGS. 6 and 7), in which it is housed in a retracted fashion below the working area. In the lowered position, the screen 17 is housed in the container 10, below the position adopted by the central video screen 12 when it is also concealed below the working area.

The lift-up panels 11 and the screen 17 are equipped with respective motor-driven movement elements (of the known type and not illustrated), all controlled by the system 2 control unit 21 through the module 6.

Figure 6:
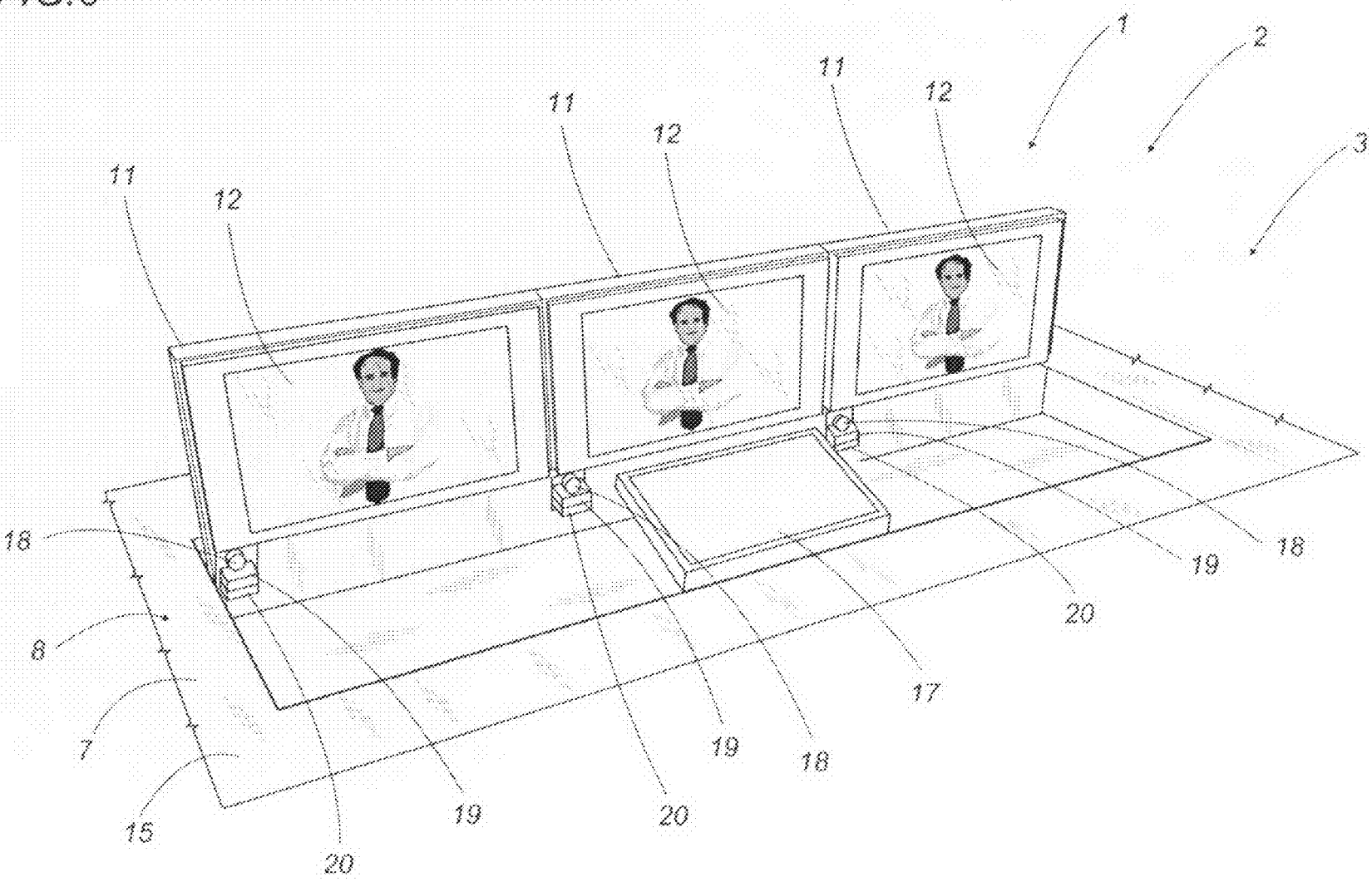
FIG. 6 is a more detailed perspective view of several details of the table of FIG. 1.

As shown in FIG. 6, each lift-up panel 11 supports not just the video screen 12, but also a high definition camera 18, preferably integrated with the video screen 12, a microphone 19 and a system of loudspeakers 20.

All of the audio-video wiring and all of the power supply, control and data transfer wiring is contained in the container 10, and is not illustrated for obvious reasons regarding clarity.

In practice, starting with the configuration of the table 1 of FIG. 1, the operator starts the system 2 using the module 6.

The control unit 21 powers the audio and video sections and starts the system 2 data management software, but it also opens the lift-up panels 11, simultaneously or one at a time. Then, after opening the lift-up panels 11, the control unit 21 lifts the screen 17, making it come out of the opening 16 and angling it towards the working position in front of the central video screen 12. Thus, the system 2 is ready and the meeting room can be connected using telepresence with a remote meeting room.

The above-mentioned plane of vision rises up from an intermediate longitudinal line of the table 1, and the video screens 12, as a whole, show an identical, virtual meeting table which is physically located in a remote position but which appears as an extension of the real table 1. In that way, the positions of the real participants are facing, in a realistic fashion, the positions of the virtual participants, as if the latter were actually present in the room.

Figure 5:
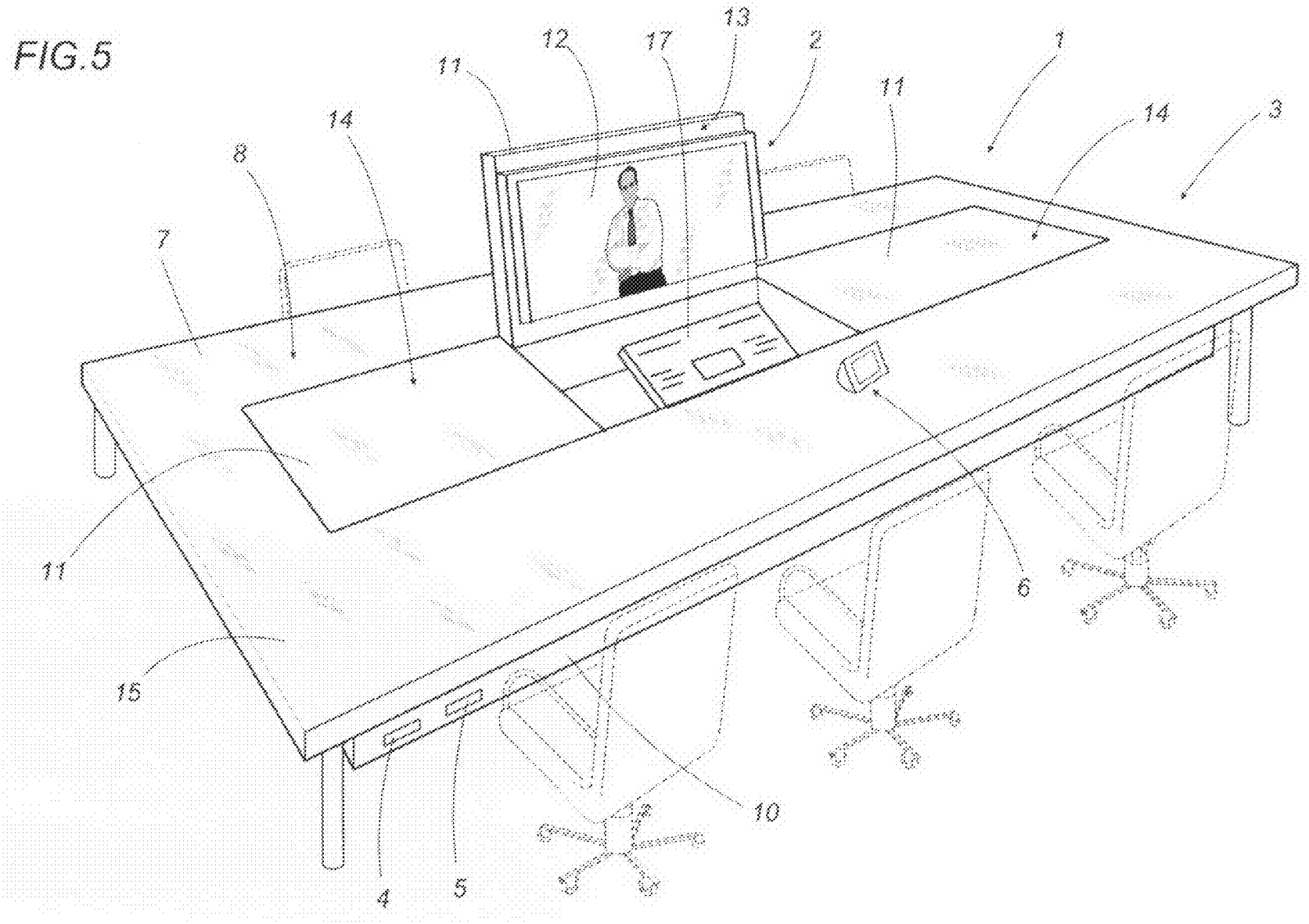
FIG. 5 is another perspective view of the table of FIG. 1 in an open configuration allowing a telepresence or videoconference meeting.

As shown in FIG. 5, the operator can select from the module 6 options menu whether to start a simple videoconference instead of a telepresence meeting, or a telepresence meeting for a more limited number of users. Therefore, assuming that the starting configuration of the table 1 is again that of FIG. 1, the action of the control unit 21 will only open the central lift-up panel 11, then it will lift up the screen 17.

According to an alternative embodiment not illustrated, the table 1 only comprises one lift-up panel 11, with a single respective video screen 12, both preferably positioned at the centre of the top 7.

According to other alternative embodiments not illustrated, the table 1 comprises two lift-up panels 11, or four or more lift-up panels 11, with respective video screens 12.

Figure 8:
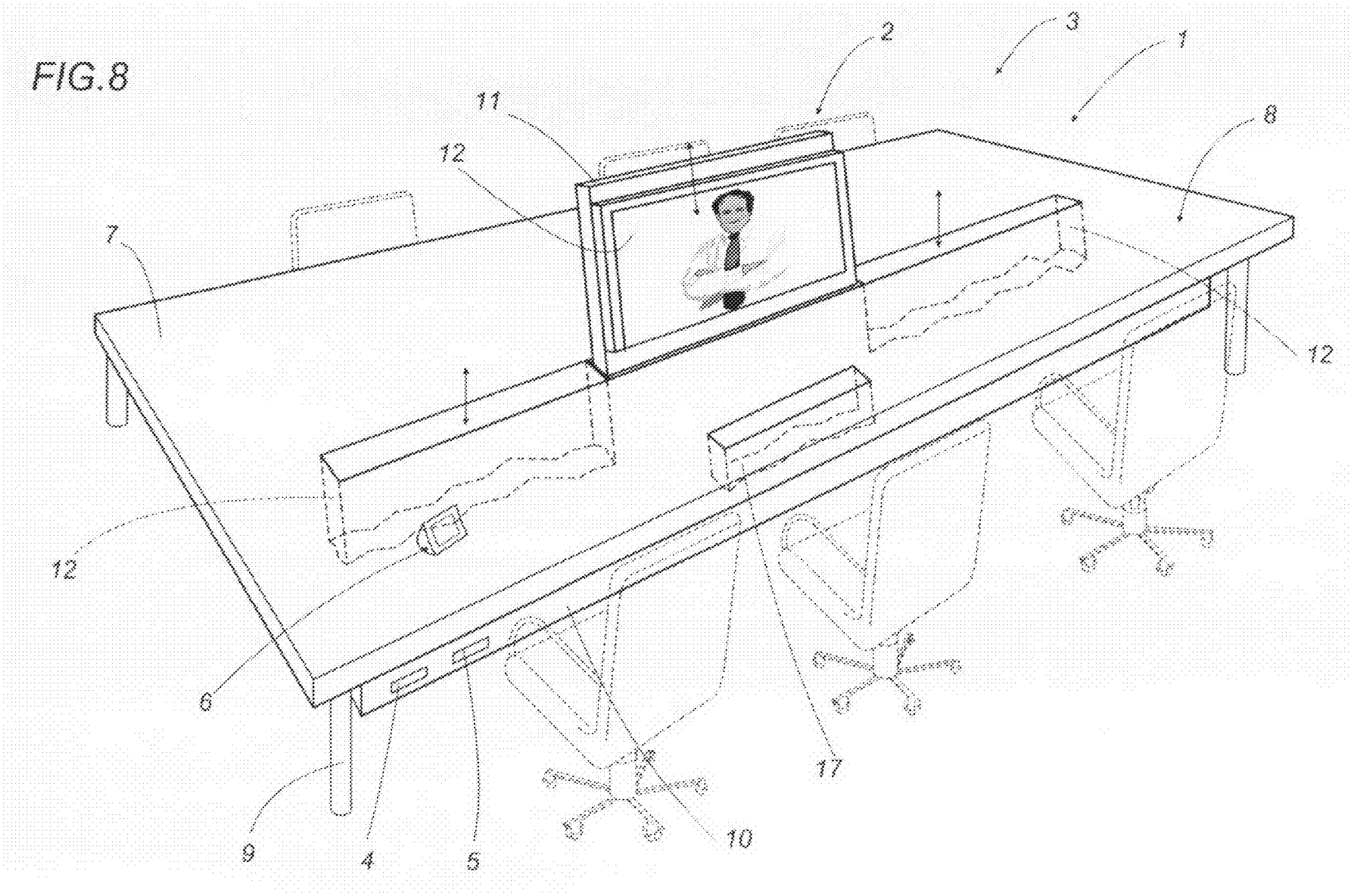
FIG. 8 is a perspective view of an alternative embodiment of the meeting table made according to the invention.

Finally, according to the alternative embodiment illustrated in FIG. 8, the hinged lift-up panels 11 are absent and both the video screen 12 and the screen 17 are motor-driven so that they come out of respective rectangular openings in the top 7 with linear motion and according to a vertical direction, also returning into the container 10 when not in use. Obviously, this solution is successful for video screens which are not too tall.

Obviously, the meeting table described above achieves the preset aims. In particular, thanks to the fact that integrated in the table, in a retractable fashion, there is a system for remote conferences, whether it is a system for videoconference or telepresence meetings, the table can be used in the traditional way, without space taken up by wiring, video screens and audio devices, when the remote conference system is not in use.

Moreover, the meeting table described above reduces the times and/or costs of installation and configuration of a meeting room intended both for traditional meetings and for videoconference or telepresence meetings, since it is already set up for remote conferences.

Finally, it should be noticed that the meeting table described above by way of example only may be modified and adapted in other ways without thereby departing from the scope of the inventive concept described in the appended claims. Moreover, all details of the invention may be substituted by technically equivalent elements.

What is claimed is:

1. A meeting table, comprising:

a horizontal top whose upper surface forms a working area;

a container positioned below the top to house a system for remote conferences; and at least one video screen positioned within a horizontal boundary of the working area which is part of the system for remote conferences; said video screen movable between a first, raised position in which it rises up from the working area, and a second, lowered position in which it is housed in a first retracted position in the container below the working area;

at least one data displaying screen positioned within a horizontal boundary of the working area and being part of the system for remote conferences; the data displaying screen for displaying data being movable between a first, raised position in which it rises up from the working area, and a second, lowered position in which it is housed in a second retracted position in the container below the working area;

wherein, when the video screen is in the first retracted position and the screen for displaying data is in the second retracted position, the screen for displaying data is positioned below the video screen.

2. The meeting table according to claim 1, comprising the system for remote conferences integrated into the meeting table to form a ready-to-use equipped structure.

3. The meeting table according to claim 1, wherein the video screen is rotatable between the first and second positions; the video screen lying parallel with the working area in the second position.

4. The meeting table according to claim 3, comprising at least one lift-up panel positioned within a horizontal boundary of the working area and belonging to the top, supporting the video screen such that it can be retracted; said lift-up panel being rotatable between a first, lifted up position in which its front face supports the video screen in the first, raised position, and a second, lowered position in which its rear face lies coplanar with a fixed part of the top, said rear face providing the working area substantial surface continuity.

5. The meeting table according to claim 4, comprising a plurality of said video screens; the video screens being positioned side by side and aligned along a plane of vision in the respective first, raised positions.

6. The meeting table according to claim 5, comprising a plurality of lift-up panels, one for each video screen; the lift-up panels being coplanar with each other both in the first, lifted up position and in the second, lowered position.

7. The meeting table according to claim 1, wherein the system for remote conferences is a videoconference system.

8. The meeting table according to claim 1, wherein the system for remote conferences is a telepresence system.

9. The meeting table according to claim 1, comprising a plurality of said video screens; the video screens being positioned side by side and aligned along a plane of vision in the respective first, raised positions.

* * * * *